US008873769B2

(12) United States Patent
Petersen et al.

(10) Patent No.: US 8,873,769 B2
(45) Date of Patent: Oct. 28, 2014

(54) WIND NOISE DETECTION METHOD AND SYSTEM

(75) Inventors: Kim Spetzler Petersen, Køge (DK); Thomas Krogh Stoltz, Copenhagen SV (DK); Henrik Thomsen, Holte (DK)

(73) Assignee: Invensense, Inc., San Jose, CA (US)

( * ) Notice: Subject to any disclaimer, the term of this patent is extended or adjusted under 35 U.S.C. 154(b) by 613 days.

(21) Appl. No.: 13/132,546

(22) PCT Filed: Nov. 30, 2009

(86) PCT No.: PCT/EP2009/066012

§ 371 (c)(1), (2), (4) Date: Sep. 15, 2011

(87) PCT Pub. No.: WO2010/063660

PCT Pub. Date: Jun. 10, 2010

(65) Prior Publication Data

US 2012/0148067 A1 Jun. 14, 2012

Related U.S. Application Data

(60) Provisional application No. 61/120,139, filed on Dec. 5, 2008.

(51) Int. Cl.
*H04R 3/00* (2006.01)

(52) U.S. Cl.
CPC ..... *H04R 3/005* (2013.01); *H04R 2410/07* (2013.01)
USPC ..... 381/92; 381/122; 381/94.1; 381/94.2; 381/94.3; 704/226; 704/233

(58) Field of Classification Search
USPC ..... 381/92, 94.1–94.3, 94.7, 122; 704/226, 704/233
See application file for complete search history.

(56) References Cited

U.S. PATENT DOCUMENTS

| | | | | |
|---|---|---|---|---|
| 4,333,170 | A | 6/1982 | Mathews et al. | |
| 5,526,430 | A * | 6/1996 | Ono et al. | 381/26 |
| 5,568,559 | A | 10/1996 | Makino | |
| 6,493,450 | B1 * | 12/2002 | Scheuer et al. | 381/57 |
| 7,630,504 | B2 * | 12/2009 | Poulsen | 381/111 |
| 2004/0165736 | A1 | 8/2004 | Hetherington et al. | |
| 2007/0047743 | A1 * | 3/2007 | Taenzer et al. | 381/92 |
| 2008/0219470 | A1 * | 9/2008 | Kimijima | 381/92 |
| 2008/0273108 | A1 | 11/2008 | Tsutsumi | |

FOREIGN PATENT DOCUMENTS

| | | |
|---|---|---|
| CN | 1530928 | 9/2004 |
| CN | 101156436 | 4/2008 |
| EP | 1 450 353 | 8/2004 |

(Continued)

OTHER PUBLICATIONS

J. Wuttke, "Microphones and Wind," Journal of Audio Engineering Society, vol. 40, No. 10, pp. 809-817, Oct. 1992.

(Continued)

*Primary Examiner* — Disler Paul
(74) *Attorney, Agent, or Firm* — Maryam Imam; IPxLaw Group LLP

(57) ABSTRACT

The present invention relates to a multi-microphone system and method adapted to determine phase angle differences between a first microphone and a second microphone signal to detect presence of wind noise.

29 Claims, 6 Drawing Sheets

(56) References Cited

FOREIGN PATENT DOCUMENTS

| | | |
|---|---|---|
| WO | WO 03/059010 | 7/2003 |
| WO | WO 2004/008804 | 1/2004 |
| WO | WO 2007/025265 | 3/2007 |

OTHER PUBLICATIONS

H. Dillon et al., "Wind Noise in Hearing Aids: Mechanisms and Measurements," National Acoustic Laboratories, Australia, 1999.

European Patent Office, International Search Report for international application No. PCT/EP2009/066012, Jun. 2, 2010.

* cited by examiner

WIND NOISE DETECTION METHOD AND SYSTEM

RELATED APPLICATIONS

This application is a 35 U.S.C. §371 National Phase of International Application No. PCT/EP2009/066012 filed on Nov. 30, 2009, which claims priority to U.S. Provisional Application No. 61/120,139 filed on Dec. 5, 2008, the disclosure of which is herein incorporated by reference in its entirety.

The present invention relates to a multi-microphone system and method adapted to determine phase angle differences between first microphone and second microphone signals to detect presence of wind noise.

BACKGROUND OF THE INVENTION

Wind induced noise signals or wind noise presents a significant problem to sound reception in a diverse range of portable electronic equipment for outdoors use such as mobile terminals, hearing instruments, headsets, sound recording cameras etc. Wind noise is often annoying during a conversation where it can lower intelligibility of desired speech signals by auditory masking of important speech cues and during sound recordings where wind noise corrupts fidelity of music recordings.

Wind noise is caused by turbulent airflow around surface features proximate to microphone inlet ports of the portable electronic equipment. These surface features convert a steady flow of wind into turbulent pressure fluctuations which are picked up by the microphones like other, but desired, pressure fluctuations. Investigations into causes of wind noise generation in hearing instruments, that are worn behind the user's ear or in the user's ear canal, have even demonstrated that a part of the wind noise is attributable to turbulence created by the airflow around the ear and head of the user, Dillon, H., Roe, I., and Ketch, R. (1999), "Wind noise in hearing aids: Mechanisms and measurements", Nat. Acoustic Labs Australia. It follows that combating wind noise by redesign of relevant surface features of the portable electronic equipment alone appears to be an unpromising path.

The spectrum and level of the wind noise induced signals have been shown by the present inventor and others to depend on the wind speed and on placement, shape and dimensions of the portable electronic equipment. However, wind noise is mainly concentrated at low frequencies of the audible frequency spectrum. Earlier reports have shown wind noise spectra that are relatively flat below 300 Hz or below 100 Hz. A prior art mechanism to reduce wind noise has been to place a screen over the microphone inlet ports to reduce turbulence, and many effective windscreens have been developed for sound-recording microphones (Wuttke, J. (1991), "Microphones and the wind", J. Audio Eng. Soc, Vol. 40, pp 809-817). However, a wind screen is often an impractical solution for many types of portable electronic equipment given the normal severe constraints on size and appearance.

PRIOR ART

US 2007/0047743 A1 discloses a sensor/microphone beamforming system that comprises two spaced-apart microphones. The system applies a phase enhancement process that may include phase expansion of the microphone signals before the beamforming process. Noise discrimination of the system is improved by expanding the regions of spatial "null" in the directional pattern of the beamforming system.

U.S. Pat. No. 4,333,170 discloses an acoustical source detection and tracking system. The system comprises an array of microphones where microphone signals from a pair of microphones are digitized and subjected to FFT transformation. Phase differences are computed from the pair of digitized microphone signals for certain selected frequency bins and the phase difference divided by the frequency value of the bin in question to determine a phase difference slope. Signals that share a common phase difference slope are grouped together and categorized as emanating from the same acoustical source.

In general prior art methods of detecting and suppressing wind noise have relied on detecting certain amplitude features of wind noise in a microphone signal. Once wind noise has been detected an appropriate signal processing strategies has been selected to attenuate or suppress those frequency bands deemed to be contaminated by wind noise signals. Making a reliable detection of wind noise signals has, however, proven to be difficult for example due to overlapping spectral or temporal content of the wind noise signals and desired signals such as musical and speech signals. In multi-microphone systems it has been difficult to detect wind noise from two or more microphone signals due to a mismatch between sensitivity and frequency responses of two microphones.

SUMMARY OF THE INVENTION

According to a first aspect of the invention, there is provided a multi-microphone system comprising a first microphone adapted to receive sound and provide a first microphone signal representative of the sound and a second microphone adapted to receive sound and provide a second microphone signal representative of the sound. A signal processor assembly is operatively coupled to receive the first and second microphone signals and adapted to determine phase angle differences between the first microphone signal and the second microphone signal over time. The signal processor assembly is adapted to detect wind noise based on the determined phase angle differences and a predetermined decision criterion.

The first and second microphone signals may be organized in respective consecutive time segments comprising plurality of individual time segments. The first and second microphone signals may be provided to the signal processor assembly in analogue form or digital form. If the first and second microphone signals are provided in digital form, they are preferably sampled synchronously with a predetermined sampling frequency. A suitable value of the predetermined sampling frequency will vary according to application specific requirements, but may lie between 8 kHz and 48 kHz. The resolution of digitized first and second microphone signals may be selected to a value between 12 and 24 bits depending on the requirements of a particular application. In one embodiment of the invention, each of the first and second microphones comprises an integral A/D converter, arranged within respective microphone housings or casings, delivering the digitized first and second microphone signals at the predetermined sampling frequency to the signal processor assembly.

The individual time segments are preferably of same length when the first and second microphone signals are provided in digital form to support block-oriented digital signal processing algorithms such as the Discrete Fourier Transform (for example implemented by a FFT algorithm) or block-based digital filter banks. The individual time segments may be partly overlapping non-overlapping with individual time segments abutted to each other over time without intervening "gaps". In other embodiments of the invention, the first and second microphone signals are processed by digital signal processing functions, such as FIR and IIR filter banks comprising sets of adjacent band-pass and/or high-pass filters, operating on a sample-by-sample basis on the digitized first and second microphone signals to determine the respective phase angle differences in one or more sub-bands over time.

The above-described signal processing functions of the signal processor assembly are preferably implemented as software programs or routines comprising respective sets of program instructions that are executed on a programmable signal processor, such as fixed-point or floating point Digital Signal Processor or microprocessor operating on the digitized versions of the first and second microphone signals.

The present the multi-microphone system may comprise one or more microphones in addition to the first and second microphones. The multi-microphone system may be embodied as a large microphone array that comprises a plurality of individual microphones, such as between 3 and 10 microphones, mounted with a predetermined spatial relationship in a piece of portable electronic equipment. In such a microphone array, it may be advantageous to determine respective phase angle differences between several pairs of microphone signals over the consecutive time segments to determine if a particular microphone pair is subjected to wind noise. Wind noise indications for the entire microphone array can for example be based on an average of individual wind noise detections provided by each pair of microphone signals.

According to a particularly advantageous embodiment of the invention, the signal processor assembly is adapted to determine respective phase angle differences over time in one or more sub-bands located in a predetermined frequency range such a frequency range between 20 Hz and 2 kHz. Wind noise may accordingly be detected separately in each of the one or more sub-band(s) by adapting the signal processor assembly to detecting wind noise in each of the one or more sub-band(s) based on determined angle phase differences in the sub-band and a corresponding sub-band decision criterion. Detecting wind noise in each of the one or more sub-band(s) is advantageous in numerous applications especially if a plurality of sub-bands is utilized such as between 3 and 32 sub-bands. Computing the number of wind noise contaminated sub-bands makes it possible to provide a reliable bandwidth estimate of the wind noise signal. A noise cancellation or attenuation strategy or algorithm implemented on the signal processor assembly may be directed to process only those sub-bands that are detected as being contaminated by wind noise. Therefore uncontaminated sub-bands can be spared from being subjected to possible adverse audible effects of the noise cancellation or attenuation algorithm.

The signal processor assembly may be further adapted to determining respective phase angle differences of a plurality of sub-bands and averaging the respective phase angle differences of a set of sub-bands of the plurality of sub-bands prior to detecting wind noise.

In a preferred embodiment of the invention, the signal processor assembly is adapted to averaging the determined phase angle differences over time prior to detecting the wind noise. The averaging is preferably performed with a time constant between 200 milliseconds and 4 seconds.

In the previously-mentioned embodiment where the first and second microphone signals are organized in respective consecutive time segments, the signal processor assembly is preferably adapted to:

determine the phase angle differences over consecutive time segments, for each time segment, of the consecutive time segments, making a comparison between a detection criterion and a determined phase angle difference of the time segment, making a detection decision for each of the time segments, averaging the detection decisions over time prior to provide an averaged detection decision and comparing the averaged detection decision to the predetermined decision criterion.

The time segments are preferably of substantially same length which may be between 4 and 64 milliseconds.

According to another advantageous embodiment of the invention, the signal processor assembly is adapted to filtering the determined phase angle differences to remove or suppress constant phase angle differences between the first and second microphone signals prior to detecting the wind noise. This embodiment may optionally comprise a step of averaging the filtered phase angle differences with a predetermined time constant to produce an averaged phase angle difference derivative prior to detecting the wind noise. The filtering may comprise high-pass or band-pass filtering the determined phase angle differences to suppress the constant and/or slowly-varying phase angle differences. Other algorithms or filters such as a DC-cancellation algorithm may in the alternative be applied to suppress the constant phase angle differences.

Suppressing or cancelling the constant and/or slowly varying phase angle differences has several advantages as these may be caused by a changing direction from the multi-microphone system to a sound source and/or mismatch between phase responses of the first and second microphones. The mismatch between the phase responses of the first and second microphones may have a constant component caused by fabrication tolerances and a slowly varying component caused by one or more of ageing effects, temperature effects and humidity effects. However, since these constant and/or slowly varying phase angle differences are unrelated to the desired detection of wind noise they can be viewed as "noise" in the present wind noise detection process and are preferably suppressed prior to making a detection decision.

In a number of preferred embodiments of the invention the signal processor assembly is adapted to compute the phase angle differences from a frequency domain or spectral representation of the first and second microphone signals. The signal processor assembly may for example be adapted to compute first Discrete Fourier Transforms of the first microphone signal over the consecutive time segments and second Discrete Fourier Transforms of the second microphone signal over the consecutive time segments and determine the phase angle differences from respective phase angle spectra of the first and second Discrete Fourier Transforms. These embodiments of the invention are of course particularly advantageous if the signal processor assembly already applies frequency domain transforms or algorithms to the first and second microphone signals for other purposes than wind noise detection. In the latter situation, the phase angle differences, or averaged phase angle differences, may be computed directly from existing phase spectrum data with a minimum of additional computational effort.

The first and second Discrete Fourier Transforms may comprise between 64 and 1024 frequency bins and the one or more sub-bands of each of the first and second microphone signals for example correspond to respective frequency bins, or sets of frequency bins, of the first or second Discrete Fourier Transforms.

The multi-microphone system may comprise a sample rate converter operatively interconnected in-between the first and second digital microphone signals and the signal processor assembly. The sample rate converter is adapted to downsample the first and second digital microphone signals to a lower sampling frequency than the predetermined sampling frequency—for example by dividing the predetermined sampling frequency with an integer number such as 2, 4, 8 etc. This embodiment is highly useful in situations where the wind noise detection can be performed at a much lower sampling rate or frequency than the predetermined sampling frequency. Detecting wind noise at the lower sampling frequency leads to substantial savings in computational resources imparted to the signal processor assembly and thus to a corresponding reduction of power consumption.

The signal processor assembly may comprise a software programmable microprocessor such as a programmable fixed-point or floating point Digital Signal Processor adapted to execute a set of program instructions to provide the present wind noise detection algorithms. Alternatively, the signal processor assembly may comprise dedicated or hard-wired arithmetic and logic circuitry adapted to perform some or all of previously-mentioned the wind noise detection algorithms or functions. In other embodiments of the signal processor assembly, the signal processor assembly is implemented as a hybrid of dedicated or hard-wired arithmetic and logic circuitry for certain signal processing functions and software program instructions for other signal processing functions.

In a preferred embodiment of the invention, the predetermined decision criterion comprises a phase angle difference threshold so that wind noise is detected by a comparison between the phase angle difference threshold and at least one of the determined phase angle differences, the determined averaged phase angle differences and the determined averaged phase angle difference derivatives. The threshold based detection scheme requires only small or modest computational effort. In case the signal processor assembly is adapted to determine respective phase angle differences in the one or more sub-bands, each of the sub-bands may comprise a corresponding decision criterion specific to the sub-band in question such as a sub-band phase angle difference threshold. In this situation, wind noise may for example be detected in each sub-band from a comparison between the sub-band phase angle difference threshold and the determined phase angle differences, or the phase angle difference derivatives, in the sub-band. The sub-band phase angle difference thresholds may be set to the same value for all sub-bands, or different values. In other embodiments, determined phase angle differences across a plurality of sub-bands are combined and averaged before a comparison is made with the predetermined decision criterion.

The present the signal processor assembly may be adapted to utilize an energy estimate of the first or second microphone signals in a predetermined frequency band as a second predetermined decision criterion in connection with the wind noise detection. The energy estimate may be determined over an entire bandwidth of one or both of the first or second microphone signals or over one of the previously-described sub-bands. The energy estimate is preferably used by the signal processor assembly to determine whether a microphone signal of the first and second microphones, at any particular point in time, or over a specific time segment, contains sufficient energy or power to be caused by wind noise. The computed energy or power estimates can for example be compared with a preset energy or power threshold to estimate whether or not the microphone signal in question is likely to be caused by wind noise.

If the energy or power estimate is low, relatively to a preset energy or power threshold or similar criterion, the additional decision criterion may cause the signal processor assembly to skip wind noise detections derived from the determined phase angle differences. Such low energy or power microphone signals may be dominated by random self-noise contributions generated by electronic and/or acoustical circuitry of the first or second microphones. These random self-noise contributions are by nature uncorrelated between the first and second microphone signals and may generate a stream of phase angle differences that resemble wind noise induced phase angle differences.

Various signal processing schemes may be applied by the signal processor assembly in response to a detection of wind noise to improve perceptual qualities of the first and second microphone signals. The signal processor may attenuate one or more predetermined sub-band(s) of the first and second microphone signals for example by applying an adaptive high-pass filter with a cut-off frequency set according to a detected bandwidth of wind-noise signals.

According to a second aspect of the present invention, there is provided a piece of portable electronic equipment, such as a mobile terminal or portable communication device, comprising a multi-microphone system according to any of the above-described embodiments of the multi-microphone system. A housing of the piece of portable electronic equipment has an outer surface comprising first and second sound inlets arranged with a predetermined distance there between. The first and second microphones of the multi-microphone system are acoustically coupled to the first and second sound inlets, respectively. The predetermined distance between the first and second sound inlets may vary widely depending on housing or casing dimensions of the piece of portable electronic equipment. Useful distances may lie between 5 mm and 100 mm such as between 10 and 30 mm since these distance ranges often are used in acoustical beamforming applications.

According to a third aspect of the present invention a method of detecting wind noise comprises steps of:

a)—generating a first microphone signal representative of received sound, b)—generating a second microphone signal representative of received sound, c)—determining phase angle differences between phases of the first microphone signal and phases of the second microphone signal over time, d)—detecting wind noise based on the determined phase angle differences and a predetermined decision criterion.

A preferred embodiment of the method comprises further steps of e)—dividing each of the first and second microphone signals into one or more sub-bands, f)—determining respective phase angle differences over time in the one or more sub-bands.

The method of detecting wind noise may optionally comprise any of below-mentioned steps g) to j):

g)—detecting wind noise in each of the one or more sub-bands based on determined angle phase differences in each sub-band and a sub-band decision criterion, h)—converting the first and second microphone signals, respectively, into respective digital microphone signals at a predetermined sampling frequency, such as a sampling frequency between 8 kHz and 96 kHz, i)—filtering the determined phase angle differences to remove or suppress constant phase angle differences prior to detecting the wind noise for example by a high-pass or band-pass filter, j)—averaging the determined phase angle differences over time prior to detecting the wind noise.

According to a third aspect of the present invention there is provided a computer readable data carrier comprising executable or compilable program instructions adapted to cause a programmable signal processor to execute steps c)-d) of the above-mentioned method of detecting wind noise. The computer readable data carrier may comprise a magnetic or an optical disc, an EEPROM or EPROM chip, a flash-memory stick, or other types of non-volatile electronic memory assemblies.

The computer readable data carrier preferably comprises program instructions in addition to those required to execute steps c)-d) above. The additional program instructions are capable of causing the programmable signal processor to execute any of steps e)-j) of the above-mentioned method of detecting wind noise. The program instructions may be provided in source code format that need to be compiled such as C++ program code or assembler program code. In other embodiments the program instructions comprises executable program code for various types of proprietary or commercially available Digital Signal Processors. The program instructions may be adapted for execution on programmable Digital Signal Processors like the TigerSHARC® series or the SigmaDSP® series of DSPs manufactured by Analog Devices.

According to a fourth aspect of the present invention there is provided a signal processing product kit comprising a carrier, such as printed circuit board or ceramic substrate, having first input terminal adapted to receive a first microphone signal and a second input terminal adapted receive a second microphone signal. A programmable signal processor is mounted on the carrier and operatively coupled to the first and second input terminals to receive the first and second microphone signals. A computer readable data carrier comprising executable or compilable program instructions as described above also forms part of the signal processing product kit. In one embodiment, the computer readable data carrier comprises an electronic memory such as an EEPROM or flash-memory chip mounted onto the carrier in proximity to the programmable signal processor and in another embodiment the computer readable data carrier comprising electronic memory integrated with the programmable signal processor on a common semiconductor substrate.

BRIEF DESCRIPTION OF THE DRAWINGS

A preferred embodiment of the invention will be described in more detail in connection with the append drawings in which.

DESCRIPTION OF PREFERRED EMBODIMENTS

Figure 1:
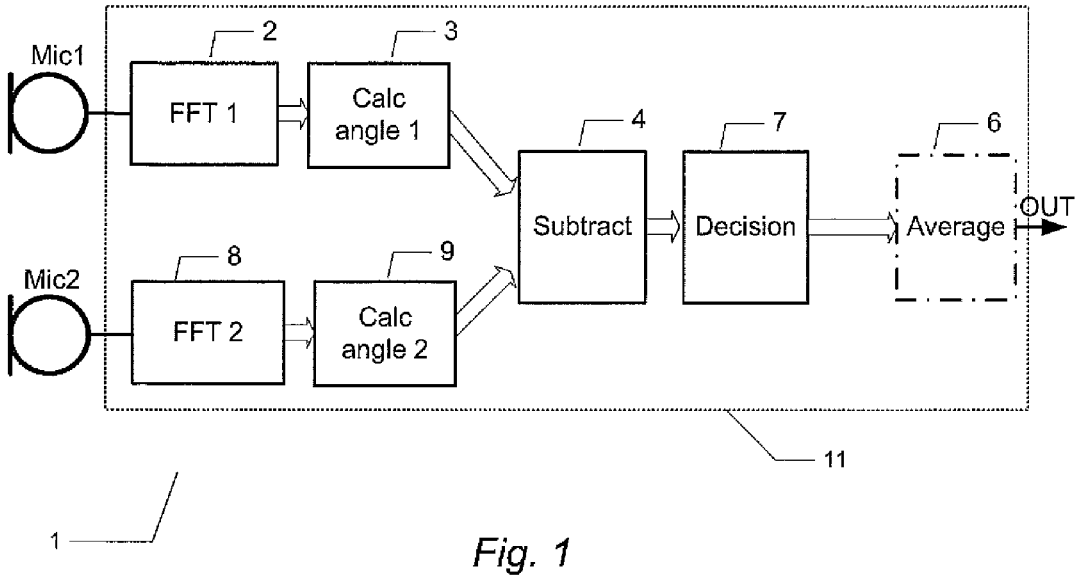
FIG. 1 is a schematic drawing of a multi-microphone system according to a first embodiment of the present invention.

A number of preferred embodiments of the invention will be described in the following passages. To assist comparisons between the different embodiments corresponding features have been indicated by similar reference numerals on the drawings.

FIG. 1 a schematic drawing of a multi-microphone system 1 according to a first embodiment of the present invention comprising a first microphone, Mic 1, and a second microphone, indicated as Mic 2, operatively coupled to a signal processor assembly 11 so as to supply first and second microphone signals thereto. The first and second microphone signals are preferably provided in digital form to the signal processor assembly 11, but A/D converters have been left out of the drawing for simplicity. In practice, each microphone, Mic 1 and Mic 2, may comprise an integral A/D converter so as to supply a digital microphone signal at a predetermined sampling frequency. Alternatively, the signal processor assembly 11 may comprise a pair of suitable A/D converters, or a single multiplexed A/D converter, coupled to receive the first and second microphone signals in analog form and convert these to digital form before routing to the signal processor assembly 11.

The signal processor assembly 11 comprises first and second FFT functions 2 and 8, respectively, operatively coupled to respective phase angle determination units 3, 9. Respective phase angles of the first and second microphone signals as determined by the phase angle determination units 3, 9 are subtracted by subtraction function 4 to provide a phase angle difference for a particular time segment of the microphone input signals processed by the FFT function 2.

The length of the time segment is set by the size of one of the first and second FFT functions and a selected sampling frequency. The first and second FFT functions may process non-overlapping or partly overlapping individual time segments of the consecutive time segments of each of the first and second microphone signals. In the present embodiment of the invention, each of the first and second microphone input signals is sampled at 16 kHz. The respective time segments of the first and second microphone input signals are provided as signal sample sets of 1024 samples corresponding to a time segment of 64 milliseconds. Each of the first and second FFT functions 2, 9 processes the relevant signal sample set of non-overlapping time segments resulting in a FFT size of 1024 bins. The frequency resolution of each of the first and second FFT functions is accordingly defined to be 15.6 Hz which means that respective phase angles of the first and second microphone signals are determined in equidistant sub-bands ranging from 0 Hz to 8 kHz with 15.6 Hz spacing. The sampling frequency and size of the first and second FFT functions may of course vary depending on the specific application and its need for frequency resolution. In a number of useful embodiments of the invention, the sampling frequency lies between 8 kHz and 48 kHz. In these embodiments the size of each of the first and second FFT functions may vary between 64 bins and 1024 bins.

The output of subtraction function 4 is respective phase angle differences over time for one or more of the 1024 frequency bins where each phase angle difference in a bin or sub-band corresponds to a FFT processed time segment of 64 milliseconds. In the present embodiment, the decision function 7 receives the computed phase angle difference in just a single sub-band in form of FFT bin 3. FFT bin 3 corresponds to a sub-band centered at a frequency of 46.8 Hz. However, other embodiments may naturally compute respective phase angle differences in many additional FFT bins and route these separately to the decision function 7.

The decision function 7 applies a phase angle difference threshold of approximately 50 degrees as decision criterion to the determined phase angle differences of FFT bin 3. The decision function 7 generates a binary decision signal on indicated terminal OUT which decision signal indicates presence or absence of wind noise in the first and second microphone input signals. Since determined phase angle differences at low frequencies where FFT bin 3 is located are much smaller for sound generated by speech sources and other natural acoustic sources than phase angle differences generated by wind noise, the present inventors have determined that reliable discrimination or detection of wind noise is possible. A reliable detection of wind noise requires an appropriate choice of detection criterion such as the previously-mentioned phase angle difference threshold.

The reliability of the wind noise detection may furthermore be improved in the present embodiment of the invention by subjecting the binary decision signal to an optional averaging function as indicated by dashed box 6 of FIG. 1. The operation of the wind noise detection will be explained with reference to FIGS. 7*a*) and *b*) that show respective plots of phase angle differences at the output of the subtraction function 4 for the multi-microphone system 1 over a time period of about 27 seconds corresponding to about 422 consecutive and non-overlapping individual time segments of each of the first and second microphone signals. The x-axis represents time plotted in units of seconds while the y-axis represents the determined phase angle difference plotted in degrees.

Figure 7:
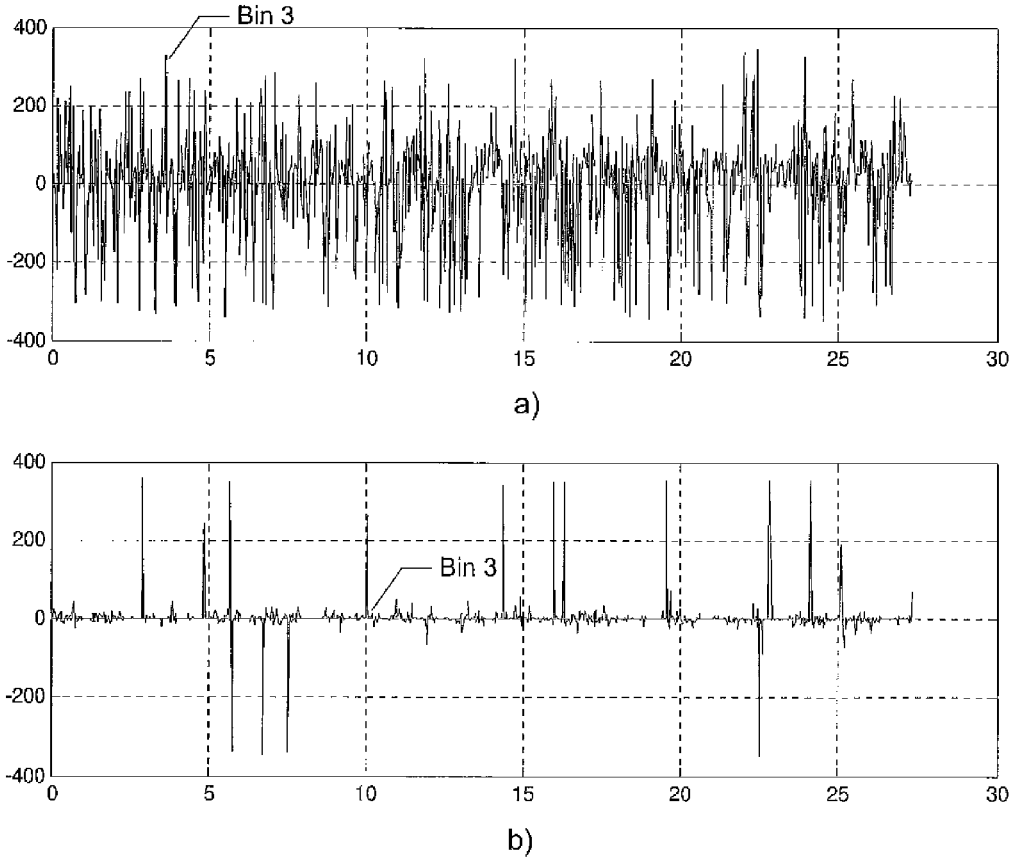

FIG. 7*a*) shows the output of the subtraction function 4 for a signal that comprises a combination or mixture of wind noise and speech while FIG. 7*b*) shows the corresponding output for a speech alone signal. The first and second microphone input signals generated by the sound signals described above were recorded from a pair of omni-directional microphones mounted inside a digital still camera with a sound port distance of 12 mm. Wind velocity for the recording of the wind noise signal was set to approximately 5 m/s. The first and second microphone input signals were both sampled synchronously with a sampling frequency of 16 kHz and the digitized first and second microphone signals exported to MATLAB for signal processing and graphing in accordance with the previously-described FFT analysis.

Inspecting FIG. 7*a*) demonstrates that the determined phase angle differences generated by the combined wind noise and speech sound are of random character with great variation over time. On the other hand, FIG. 7*b*) shows that the determined phase angle differences have low variability and low average value despite a few isolated spikes. The random character of the wind noise and speech generated phase angle differences in FIG. 7*a*) can be attributed to a turbulent and random nature of acoustic pressure fluctuations at low frequencies, in this case frequencies around 46.8 Hz where bin 3 is centered in the frequency spectrum. The much lower variability of the speech alone generated phase angle differences in FIG. 7*b*) is to be expected from low frequency signals generated by a non-turbulent acoustic source. This is because a phase angle difference between the first and second microphone signals for such an acoustic source is set by the sound port distance and a direction (e.g. front, back or sideways) to the acoustic source. In the present multi-microphone system 1, the 12 mm sound port distance should produce phase angle differences between approximately +/−0.4 degrees at 46.8 Hz depending on the direction to the acoustic source. In addition to this small theoretical phase angle difference additional phase angle differences will often be introduced by a mismatch between phase responses of the first and second microphones. The additional phase angle differences caused by mismatching frequency and/or phase response between the first and second microphones are essentially constant over time periods that are relevant in the connection with the present wind noise detection schemes. This latter observation can lead to further improvements in the detection of wind noise as described below with reference to the embodiments of the invention depicted in FIGS. 3 and 4.

In the present embodiment of the invention, the inventors have demonstrated that the reliability of the wind noise detection can be improved by removing the visible spikes in the phase angle differences of FIG. 7*b*). This can be done by adapting the subtraction function 4 to perform a more sophisticated detection of the phase angle differences between the first and second microphone signals by computing the shortest phase angle difference around a z-transform unit circle. However, it is clear that wind noise can be detected in a reasonably reliable manner directly from the respective phase angle differences depicted in FIGS. 7*a*) and *b*) by applying suitable averaging prior to making a detection decision or applying detection decisions directly to the determined phase angle differences and averaging the outcome. For example, setting a phase angle difference threshold to a value between approximately 30 and 50 degrees as a predetermined decision criterion and comparing this threshold with suitably averaged versions of the wind noise generated phase angle differences and the speech generated phase angle differences will lead to correct identification or detection of the different sounds.

The skilled person will understand that the above-described signal processing functions of the signal processor assembly 11 may be implemented by respective sets of program instructions or program routines of a programmable signal processor such as Digital Signal Processor or microprocessor. The above-described signal processing functions may alternatively be implemented as fixed or non-programmable application specific circuit blocks comprising appropriately configured arithmetic and logic circuitry or implemented as a hybrid of program routines/software and fixed application specific circuit blocks.

Figure 2:
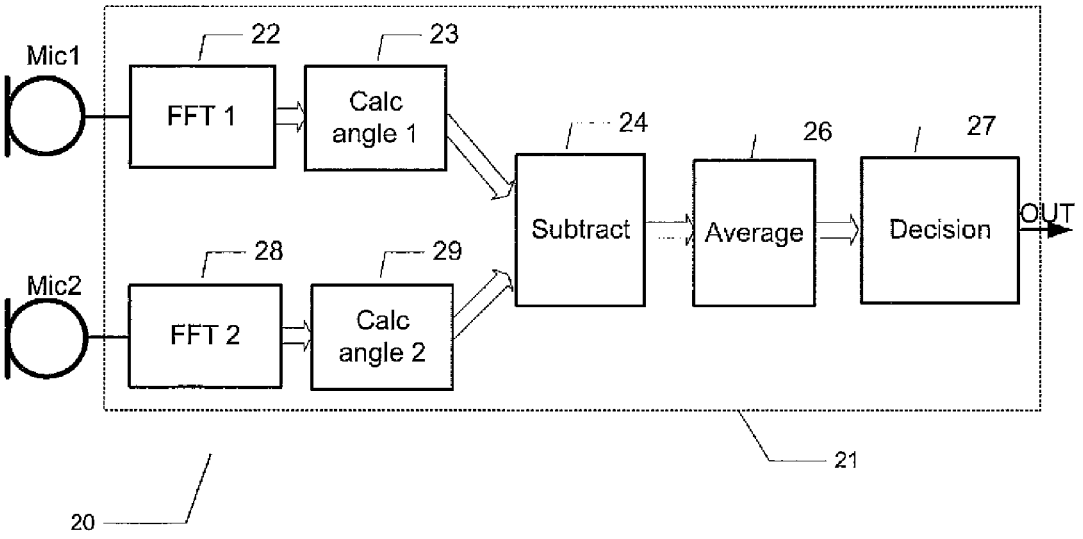
FIG. 2 is a schematic drawing of a multi-microphone system according to a second embodiment of the present invention.

FIG. 2 is a schematic drawing of a multi-microphone system 20 according to a second embodiment of the present invention. Compared to the multi-microphone system 1 described above in connection with FIG. 1, the present multi-microphone system 20 comprises an additional averaging function 26 operatively coupled in-between a subtraction function 24 and a decision function 27 within the signal processor assembly 21. Functions and devices in the present embodiment of the invention are otherwise substantially identical to the correspondingly marked functions and devices in the first embodiment of the invention and will therefore not be described in more detail than necessary.

Phase angle differences between the first and second microphone signals are determined by subtraction function or unit 24 and routed to the averaging function 26 which averages or smoothes rapid variations of the phase angle differences with a predetermined averaging time constant. The value of the predetermined averaging time constant can vary widely depending on specific requirements, such as microphone sound port distance and desired response times of the wind noise detection signal on terminal OUT, of a particular application. In the previously-described application as sound recording system of a still camera, the predetermined averaging time constant is preferably set to a value between 25 milliseconds and 8 seconds, or more preferably between 200 milliseconds and 4 seconds such as around 1 second. The averaging function 26 serves to smooth out isolated random signal spikes or signal anomalies in the first or second microphone input signals to prevent the decision function 27 from introducing false or unwanted detection decisions. By inspecting the determined phase angle differences for the speech of FIG. 7*b*), it is readily apparent that applying the present averaging function 26, for example with an averaging time constant around 1 second, to the determined phase angle differences will to a very high degree suppress the few isolated phase angle spikes. These isolated phase angle spikes are created in pauses in the speech signal where random noise of very low level dominates the first and second microphone signals. By suppressing the few isolated phase angle spikes in the generated phase angle differences, a simple threshold based detection criterion will provide very good discrimination between the speech alone signal FIG. 7*b*), and the wind noise and speech signal in FIG. 7*a*) even under these conditions. These isolated phase angle difference spikes can be suppressed in the wind noise detection process or algorithm by using an additional energy estimate of the first and second microphone signals in connection with the wind noise detection.

Figure 3:
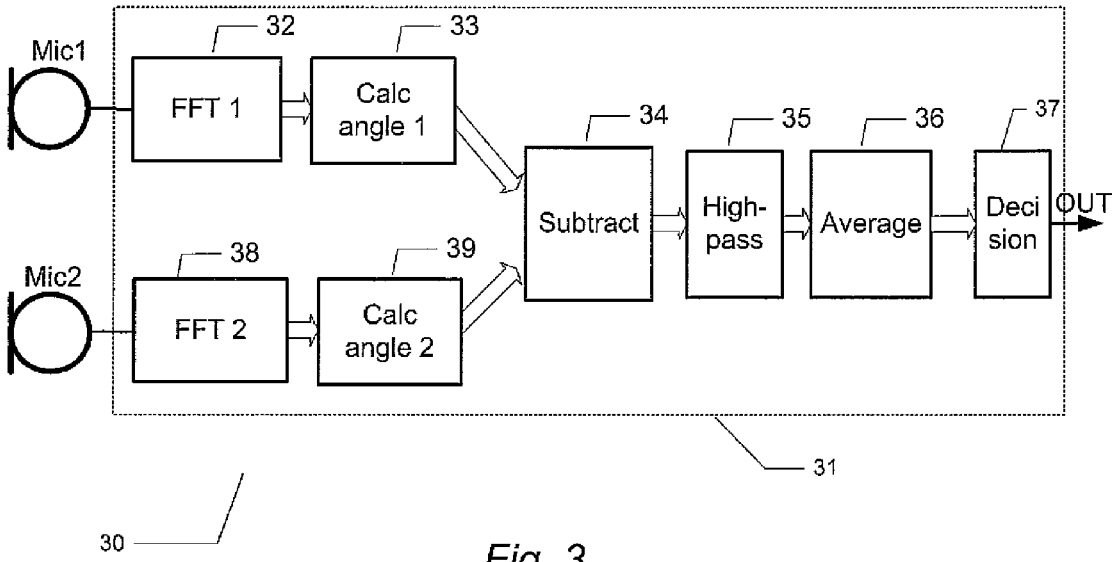
FIG. 3 is a schematic drawing of a multi-microphone system according to a third embodiment of the present invention.

FIG. 3 is a schematic drawing of a multi-microphone system 30 according to a third and preferred embodiment of the present invention. Compared to the multi-microphone system 20 described above in connection with FIG. 2, the present multi-microphone system 30 comprises a high-pass filter 35 operatively coupled in-between a subtraction function 34 and an averaging function 36 within the signal processor assembly 31. Functions and features in the present embodiment of the invention are substantially identical to the correspondingly marked functions and features in the second embodiment of the invention and will therefore not be described in more detail than necessary.

Another difference between the present embodiment and the previously-described first and second embodiments of the invention is that the phase angle differences between the first and second microphone signals are determined separately in three different sub-bands in the present multi-microphone system compared to the single sub-band, FFT bin 3, in the previous embodiments.

In the present embodiment respective phase angle differences between the first and second microphone signals are determined by subtraction function or unit 34 in the sub-bands defined by FFT bins 3, 4 and 5. The determined phase angle differences in each sub-band are routed to the high-pass function 35 which suppresses or removes constant and slowly-varying phase angle differences in each sub-band between the first and second microphone signals. The illustrated high-pass function 35 is an exemplary choice for obtaining a desired suppression of the constant and slowly-varying phase angle differences. Other functions or filters such as DC-cancellation or band-pass filter functions may be used instead.

The constant and slowly-varying phase angle differences may as previously-discussed be caused by a varying direction between the sound source and the multi-microphone system 30 and/or mismatch between the phase responses of the first and second microphones. The mismatch between the phase responses of the first and second microphones may have a constant component and a slowly varying component caused by one or more of ageing effects, temperature effects and humidity effects. However, since these constant and slowly-varying phase angle differences are unrelated to the desired detection of wind noise they can be viewed as a sort of "noise" which advantageously can be removed or suppressed prior to making a detection decision in the decision unit 37.

An output of the high-pass function 35 is a phase angle difference derivative over time for each sub-band. The phase angle difference derivative for each sub-band is preferably averaged or smoothed over individual time segments by setting an averaging time constant between 200 milliseconds and 4 seconds in the averaging function 36. An averaged phase angle difference derivative for each sub-band is thereafter routed to the decision unit 37 that applies a predetermined detection criterion to the averaged phase angle difference derivative of each sub-band to determine whether the first and second microphone input signals are contaminated with wind noise or not in each sub-band.

The operation and experimental results of the present multi-microphone wind noise detection system 30 will be further explained with reference to FIGS. 5 and 6 that show respective plots of phase angle derivative differences at the output of the averaging function 36 for the multi-microphone system 30 over the time period of about 27 seconds for the previously-presented (refer to the description in connection with FIG. 1) wind noise+speech signal and speech-alone signal recorded by the digital still camera. The upper plot, FIG. 5*a*), shows determined phase angle derivatives as function of time for the three different indicated sub-bands corresponding to FFT bins 3, 4 and 5. These FFT bins correspond to sub-bands centred at frequencies of about 47 Hz, 62 Hz and 78 Hz, respectively. The averaging time constant has been set to 2 seconds in the averaging function 36 for each of the sub-bands. The lower plot, FIG. 5*b*) shows measured signal amplitudes over time for each of the first and second microphone input signals. These signal amplitudes are very similar making the plots overlaid and difficult to distinguish visually.

Figure 5:
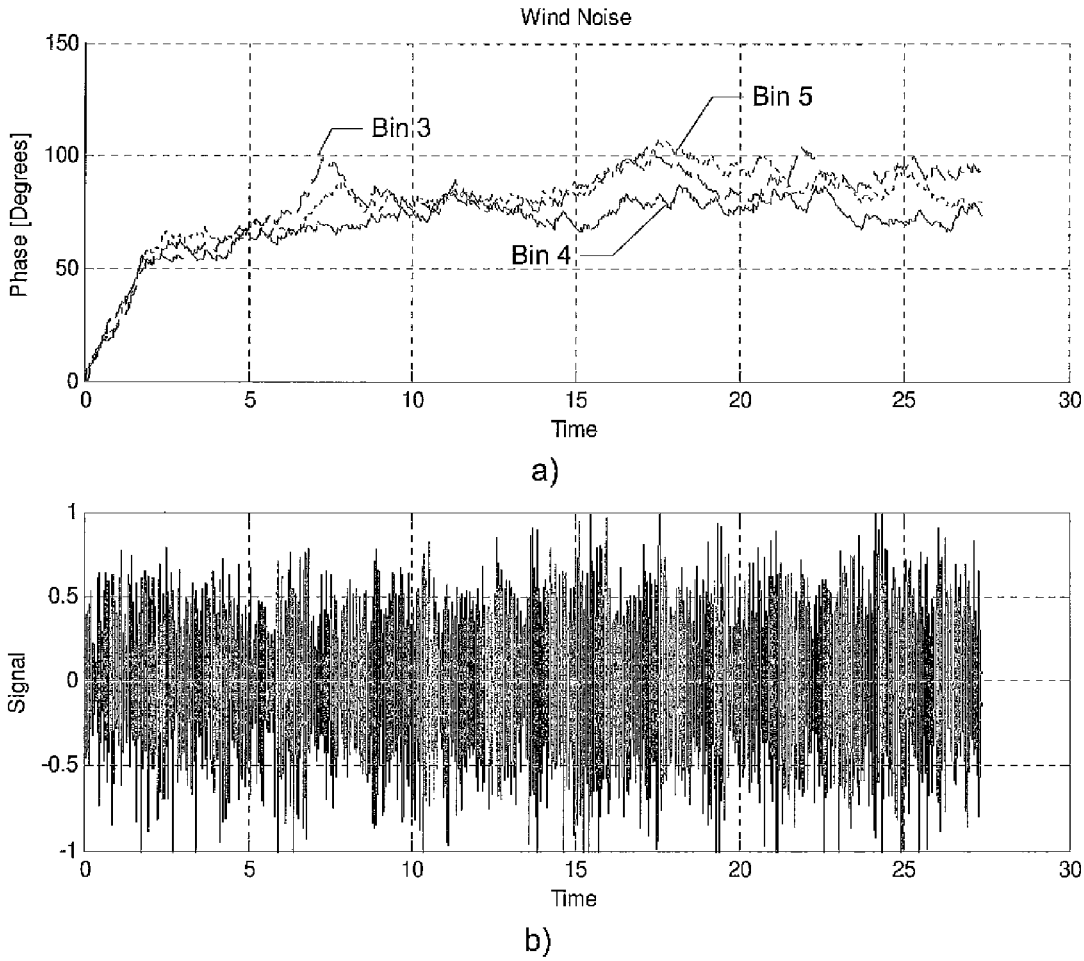
Figure 6:
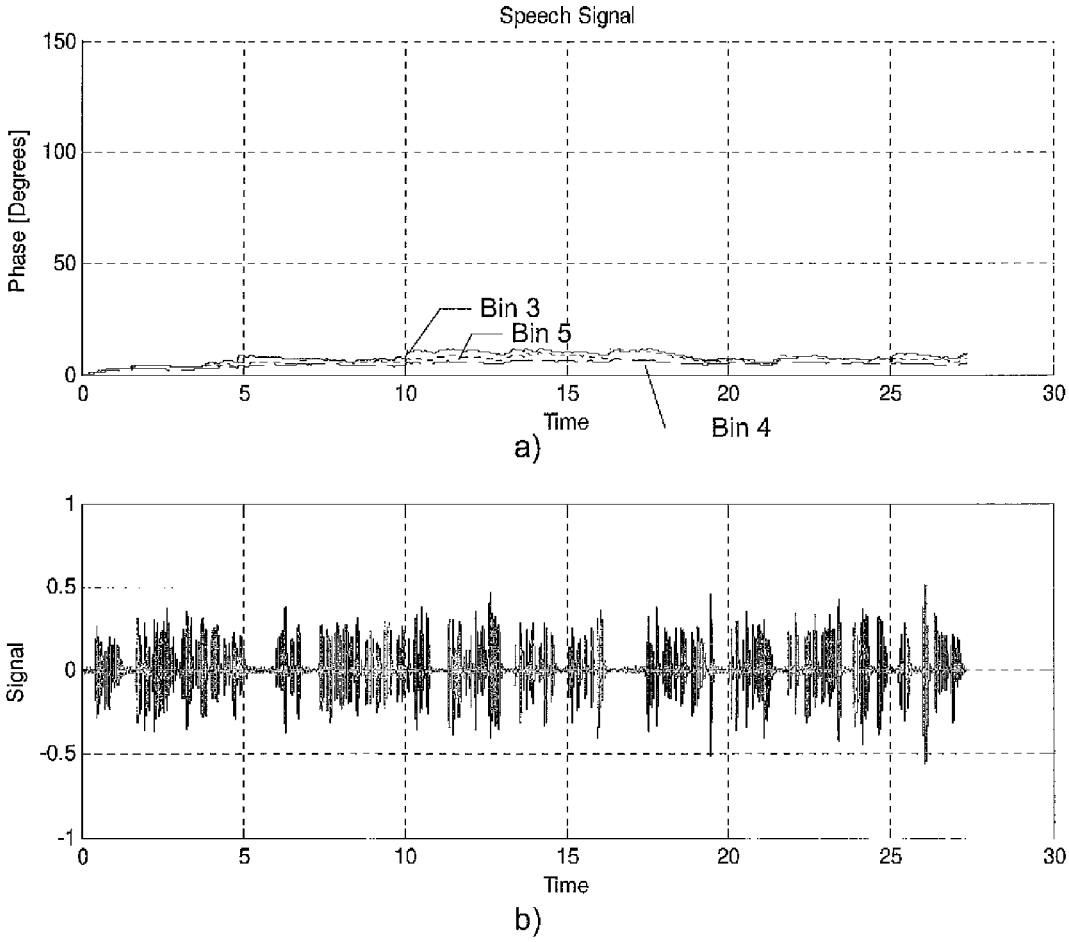

The upper and lower plots in FIGS. 6*a*) and *b*) correspond to the upper and lower plots FIGS. 5*a*) and *b*), but this time for a speech signal alone with the same amplitude as the speech signal in FIG. 5. A comparison of FIG. 5*a*) and FIG. 6*a*) demonstrates a pronounced difference between the determined phase angle derivative differences in all three sub-bands for the two types of signals. The determined phase angle derivative differences for the combined or composite wind noise and speech signal are confined to a range between 60 and 100 degrees without any upwardly or downwardly projecting signal spikes for all three sub-bands bins 3, 4 and 5. On the other hand, phase angle derivative differences for the speech alone are confined to a range between 5 and 15 degrees without any upwardly or downwardly projecting signal spikes for all three sub-bands. It is readily apparent that presence of wind noise can be detected in each of the sub-bands by applying a simple threshold based detection criterion, for example by a setting phase angle difference threshold to a value between 20 and 55 degrees. A fixed phase angle difference threshold within this range will provide very good discrimination between the speech alone signal of FIGS. 6*a* and *b*), and the wind noise contaminated speech signal of FIGS. 5*a*) and *b*) in each of the sub-bands. The sub-band based detection of wind noise is advantageous in numerous applications because the bandwidth of the wind noise signal can be estimated in a reliable manner by selecting and processing an appropriate number of sub-bands. This is opposite to a situation where only the presence of absence of wind noise in the entire bandwidth of first and second microphone signals can be detected. Once the bandwidth of the wind noise signal is known, the signal processor assembly may be adapted to apply noise cancellation or attenuation algorithms in a frequency-selective manner targeting only those sub-bands of the microphone signals that are detected or flagged as corrupted by wind noise.

Figure 4:
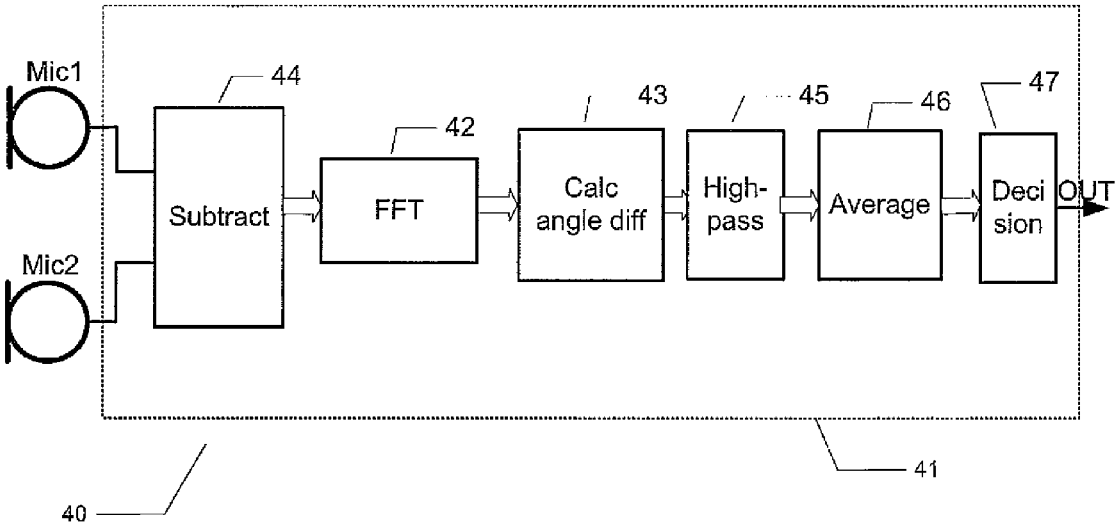
FIG. 4 is a schematic drawing of a multi-microphone system according to a fourth embodiment of the present invention, FIGS. 5*a*) and *b*) show measured microphone signal phase angle differences and amplitudes over time for the multi-microphone system depicted in FIG. 3 when subjected to sound that is a combination of speech and wind noise, FIGS. 6*a*) and *b*) show measured microphone signal phase angle differences and amplitudes over time for the multi-microphone system depicted in FIG. 3 when subjected to sound consisting of pure speech, FIGS. 7*a*) and *b*) show measured microphone signal amplitudes and phase angle differences over time for the multi-microphone system depicted in FIG. 1 when subjected to speech and wind noise.

FIG. 4 is a schematic drawing of a multi-microphone system 40 according to a fourth embodiment of the present invention. Compared to the multi-microphone system 30 described above in connection with FIG. 3, the subtraction function 44 is moved to a position prior to the FFT function 42 to provide a microphone difference signal directly representing amplitude and phase angle differences between the first and second microphone signals. The subtraction function 44 may be adapted to work on analogue or digitized microphone signals and provide the amplitude and phase angle differences in any or these domains. If the subtraction function 44 operates in the analogue domain a suitable A/D converter can be arranged in-between the subtraction function 44 and the FFT function 42. An advantage of the present embodiment of the invention in comparison to the third embodiment is the requirement of only a single FFT function 42, and optionally a single A/D converter, to compute the phase angle differences or phase angle difference derivatives needed for the decision function 47. This leads to savings of computational resources, power consumption and/or hardware expenditure in the signal processor assembly 41. The phase angle differences between the first and second microphone signals in one or more FFT bins are accordingly determined directly from a phase spectrum of the single FFT function 42 which transform individual time segment of the microphone difference signal to the frequency domain.

Figure 8:
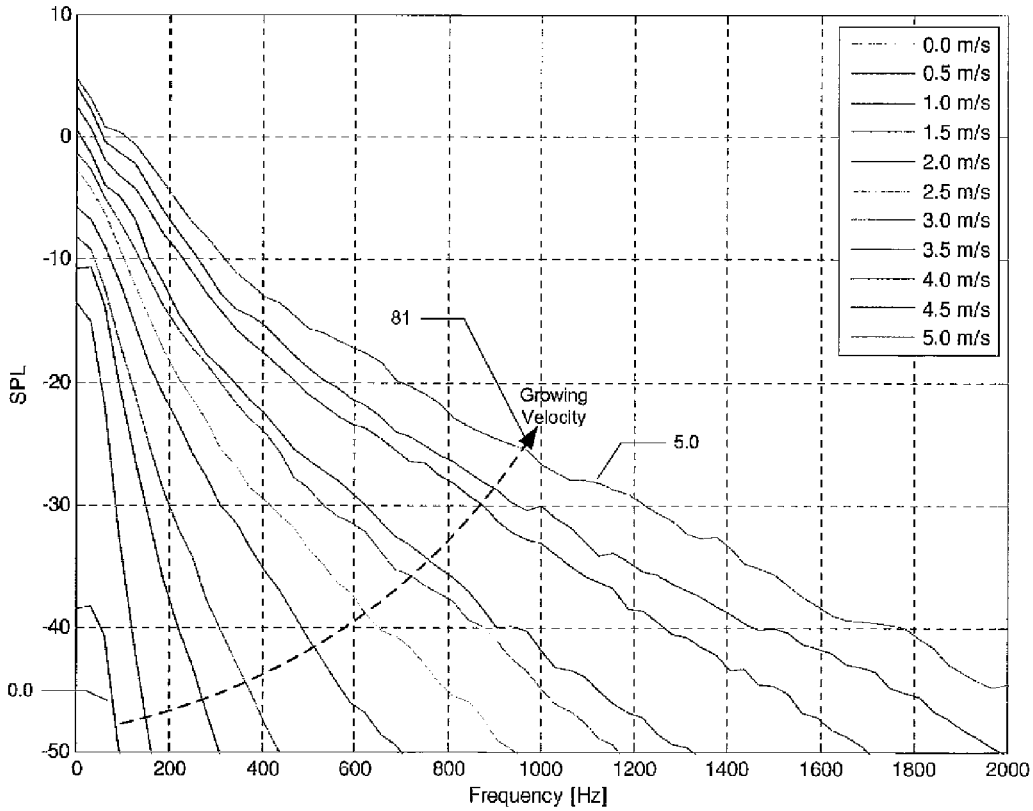
FIG. 8 shows a collection of measured relative wind noise generated sound pressure levels versus frequency for the multi-microphone system depicted in FIG. 3 for a collection of different wind velocities.

FIG. 8 shows a collection of measured relative sound pressure levels versus frequency for the multi-microphone system 30 (refer to FIG. 3) mounted in the digital still camera as previously described in connection with FIG. 3. These sound pressure levels were measured directly at the outputs of the first and second microphones by FFT analysis. Each relative sound pressure level versus frequency plot corresponds to a particular wind velocity as indicated. Increasing wind velocities, from about 0.5 m/s to 5.0 m/s, are indicated by a direction of arrow 81. It is apparent that even though the wind noise signal is concentrated at low frequencies for all depicted wind velocities it has a relatively broad frequency spectrum with a significant overlap of the human speech range that extends in frequency from about 200 Hz to 8 kHz. This overlap can lead to lower intelligibility and fidelity of incoming speech and music signals to the microphone system.

The invention claimed is:

1. A multi-microphone system comprising:

a first microphone to receive sound and provide a first microphone signal representative of sound, a second microphone to receive sound and provide a second microphone signal representative of the sound, a signal processor assembly operatively coupled to receive the first and second microphone signals, and the signal processor assembly to:

determine phase angle differences between phase angles of the first microphone signal and phase angles of the second microphone signal over time, detect wind noise based on the determined phase angle differences and a predetermined decision criterion, determine the phase angle differences over consecutive time segments, for each time segment of the consecutive time segments make a comparison between a detection criterion and a determined phase angle difference of the time segment, make a detection decision for each of the time segments, and average the detection decisions over time prior to providing an averaged detection decision and comparing the averaged detection decision to the predetermined detection criterion.

2. The multi-microphone system according to claim 1, wherein the signal processor assembly is to determine respective phase angle differences over time in one or more sub-bands located in a frequency range between 20 Hz to 2000 Hz.

3. The multi-microphone system according to claim 2, wherein the signal processor assembly is further to:

detect wind noise in each of the one or more sub-bands based on determined angle phase differences in each sub-band and a sub-band decision criterion.

4. The multi-microphone system according to claim 2, wherein the signal processor assembly is to:

determine respective phase angle differences of a plurality of sub-bands, average the respective phase angle differences of a set of sub-bands of the plurality of sub-bands prior to detecting wind noise.

5. The multi-microphone system according to claim 3, wherein each of the sub-band decision criterion comprises a sub-band phase angle difference threshold, and determines whether wind noise is detected in each of the one or more sub-bands based on a comparison between the sub-band phase angle difference threshold and the determined phase angle differences or the averaged phase angle difference derivatives of the sub-band.

6. The multi-microphone system according to claim 1, wherein the signal processor assembly is to:

average the determined phase angle differences over time prior to detecting the wind noise.

7. The multi-microphone system according to claim 1, wherein the signal processor assembly is to:

filter the determined phase angle differences to remove or suppress constant phase angle differences prior to detecting the wind noise.

8. The multi-microphone system according to claim 7, wherein the signal processor assembly is to:

average the filtered phase angle differences with a predetermined time constant to produce an averaged phase angle difference derivative prior to detecting the wind noise.

9. The multi-microphone system according to claim 1 wherein the signal processor assembly is to:

compute first Discrete Fourier Transforms of the first microphone signal over the consecutive time segments and second Discrete Fourier Transforms of the second microphone signal over the consecutive time segments, and determine the phase angle differences from respective phase angle spectra of the first and second Discrete Fourier Transforms.

10. The multi-microphone system according to claim 9, wherein each of the first and second Discrete Fourier Transforms comprises between 64 and 1024 frequency bins.

11. The multi-microphone system according to claim 10, wherein one or more sub-bands correspond to respective frequency bins of the first or second Discrete Fourier Transforms.

12. The multi-microphone system according to claim 1, wherein the first and second microphones are to provide the first and second microphone signals, respectively, to the signal processor assembly as respective digital microphone signals at a predetermined sampling frequency.

13. The multi-microphone system according to claim 1, wherein the signal processor assembly comprises a first and a second A/D converter to convert the first and second microphone signals, respectively, into respective digital microphone signals at a predetermined sampling frequency.

14. The multi-microphone system according to claim 13, wherein the predetermined sampling frequency lies between 8 kHz and 48 kHz.

15. The multi-microphone system according to claim 1, comprising:

a sample rate converter operatively interconnected in-between the first and second digital microphone signals and the signal processor assembly, the sample rate converter to downsample the first and second digital microphone signals to a lower sampling frequency than the predetermined sampling frequency.

16. The multi-microphone system according to claim 1, wherein the signal processor assembly comprises a software programmable microprocessor such as a fixed-point or floating point Digital Signal Processor.

17. The multi-microphone system according to claim 1, wherein the predetermined decision criterion comprises a phase angle threshold, and the signal processor assembly is to detect wind noise by comparing at least one of the determined phase angle differences and the averaged phase angle difference derivatives with the phase angle difference threshold.

18. The multi-microphone system according to claim 1, wherein the signal processor assembly is to apply another predetermined decision criterion based on an energy estimate of the first microphone signal or the second microphone signal across a predetermined frequency range.

19. The multi-microphone system according to claim 1, wherein the signal processor assembly is to:

attenuate one or more predetermined sub-band(s) of the first microphone signal or attenuate one or more predetermined sub-band(s) of the second microphone signal in response to a detection of wind noise.

20. A piece of portable electronic equipment comprising:

a housing with an outer surface comprising first and second sound inlets arranged with a predetermined distance there between, a first microphone to receive sound and provide a first microphone signal representative of the sound, a second microphone to receive sound and provide a second microphone signal representative of the sound, and a signal processor assembly operatively coupled to receive the first and second microphone signals, the signal processor assembly to:

determine phase angle differences over time between the first microphone signal and the second microphone signal, detect wind noise based on the determined phase angle differences and a predetermined decision criterion, wherein the first and second microphones are acoustically coupled to the first and second sound inlets, respectively, determine the phase angle differences over consecutive time segments, for each time segment of the consecutive time segments make a comparison between a detection criterion and a determined phase angle difference of the time segment, make a detection decision for each of the time segments, and average the detection decisions over time prior to providing an averaged detection decision and comparing the averaged detection decision to the predetermined detection criterion.

21. A method of detecting wind noise comprising:

generating a first microphone signal representative of received sound, generating a second microphone signal representative of received sound, determining phase angle differences between the first microphone signal and the second microphone signal over time, detecting wind noise based on the determined phase angle differences and a predetermined decision criterion, determine the phase angle differences over consecutive time segments, for each time segment of the consecutive time segments make a comparison between a detection criterion and a determined phase angle difference of the time segment, make a detection decision for each of the time segments, and average the detection decisions over time prior to providing an averaged detection decision and comparing the averaged detection decision to the predetermined detection criterion.

22. The method of detecting wind noise according to claim 21, further comprising:

dividing each of the first and second microphone signals into one or more sub-bands, and determining respective phase angle differences over time in the one or more sub-bands.

23. The method of detecting wind noise according to claim 22, further comprising:

detecting wind noise in each of the one or more sub-bands based on determined angle phase differences in the sub-band and a corresponding sub-band decision criterion.

24. The method of detecting wind noise according to claim 21, further comprising:

converting the first and second microphone signals, respectively, into respective digital microphone signals at a predetermined sampling frequency.

25. The method of detecting wind noise according to claim 21, further comprising:

filtering the determined phase angle differences to remove or suppress constant phase angle differences prior to detecting the wind noise.

26. The method of detecting wind noise according to claim 21, further comprising:

averaging the determined phase angle differences over time prior to detecting the wind noise.

27. A processor-readable storage device storing executable program instructions, the executable program instructions, when executed by one or more programmable signal processors for causing the one or more programmable signal processors to:

receive sound from a first microphone and generate a first microphone signal representative of the received sound, receive sound from a second microphone and generate a second microphone signal representative of the received sound, determine phase angle differences between the first microphone signal and the second microphone signal over time, detect wind noise based on the determined phase angle differences and a predetermined decision criterion, determine the phase angle differences over consecutive time segments, for each time segment of the consecutive time segments make a comparison between a detection criterion and a determined phase angle difference of the time segment, make a detection decision for each of the time segments, and average the detection decisions over time prior to providing an averaged detection decision and comparing the averaged detection decision to the predetermined detection criterion.

28. The processor-readable storage device according to claim 27, comprising additional executable program instructions to cause the one or more programmable signal processors to:

assign each of the first and second microphone signals into one or more sub-bands, and determine respective phase angle differences over time in the one or more sub-bands.

29. The signal processing product kit comprising:

a substrate, comprising:

a first input terminal to receive a first microphone signal, and a second input terminal to receive a second microphone signal, a processor mounted on the substrate and operatively coupled to the first and second input terminals to receive the first and second microphone signals, and a computer readable storage medium storing execute program instructions for causing the processor to:

receive a first microphone signal representative of a received sound, receive a second microphone signal representative of a received sound, determine phase angle differences between the first microphone signal and the second microphone signal over time, detect wind noise based on the determined phase angle differences and a predetermined decision criterion, determine the phase angle differences over consecutive time segments, for each time segment of the consecutive time segments make a comparison between a detection criterion and a determined phase angle difference of the time segment, make a detection decision for each of the time segments, and average the detection decisions over time prior to providing an averaged detection decision and comparing the averaged detection decision to the predetermined detection criterion.

* * * * *